United States Patent [19]

Rork et al.

[11] Patent Number: 4,488,044

[45] Date of Patent: Dec. 11, 1984

[54] IONIZATION CHAMBER FOR SMOKE DETECTOR AND THE LIKE

[75] Inventors: Gerald D. Rork, Sleepy Hollow; Edward J. Thorp, New Lenox; Ronald J. Zegarski, Crystal Lake, all of Ill.

[73] Assignee: Pittway Corporation, Aurora, Ill.

[21] Appl. No.: 323,471

[22] Filed: Nov. 20, 1981

[51] Int. Cl.[3] ..... H01J 47/02

[52] U.S. Cl. ..... 250/381

[58] Field of Search ..... 250/381-385; 340/629

[56] References Cited

U.S. PATENT DOCUMENTS

| | | | |
|---|---|---|---|
| 3,521,263 | 7/1970 | Lampart et al. . | |
| 3,728,706 | 4/1973 | Tipton et al. . | |
| 3,903,419 | 9/1975 | Lehsten | 250/381 |
| 3,908,957 | 9/1975 | Schütt | 250/384 |
| 3,909,815 | 9/1975 | Gacogne | 250/381 |
| 3,935,492 | 1/1976 | Sasaki et al. | 250/381 |
| 4,021,671 | 5/1977 | Solomon | 250/381 |
| 4,035,788 | 7/1977 | Barr | 250/381 |
| 4,044,262 | 8/1977 | Minowa | 250/381 |
| 4,167,687 | 9/1979 | Furney | 250/381 |
| 4,185,196 | 1/1980 | Byrne | 250/381 |
| 4,213,047 | 7/1980 | McCord | 250/381 |
| 4,227,085 | 10/1980 | Sunde | 250/385 |
| 4,238,677 | 12/1980 | Hugon | 250/381 |

*Primary Examiner*—Alfred E. Smith
*Assistant Examiner*—Carolyn E. Fields
*Attorney, Agent, or Firm*—Emrich & Dithmar

[57] ABSTRACT

An ionization smoke detector is disclosed in which an electric field is established in an ionization chamber which includes an outer cup-shaped electrode defining the chamber and having side wall apertures for permitting airflow therethrough and a circular inner electrode within the chamber. A radiation source is arranged to produce bipolar and unipolar regions in the chamber. A cylindrical control screen coaxial with the outer electrode and spaced therefrom is electrically connected to and supported by the inner electrode in the chamber.

29 Claims, 9 Drawing Figures

IONIZATION CHAMBER FOR SMOKE DETECTOR AND THE LIKE

BACKGROUND OF THE INVENTION

This invention relates to detectors of the ionization type for detecting airborne particulate matter and, in particular, to the construction of an ionization chamber for such a detector. The present invention will be discussed in terms of the application of such a detector for detecting combustion products such as smoke, but it will be understood that the invention could be used for detecting a variety of materials, such as dust, fog and the like.

Ionization-type smoke detectors are known and typically include an ionization chamber having two electrodes, means for establishing an electric field between these electrodes, and means such as a radioactive source for causing ionization within the chamber. This radiation produces ions in the chamber and the electric field creates an ion current flow between the electrodes. As combustion products enter the chamber, the ions attach themselves to these products and the magnitude of the ion current is accordingly reduced. The reduction in ion current amplitude is sensed by circuit means and when the current is reduced to a predetermined level, an electrical signal is generated which initiates a visible and/or audible alarm indication.

Prior ionization-type smoke detectors have exhibited an instability attributable to air currents which operate to trigger false alarms. More specifically, the airflow through the ionization chamber may carry some of the ions from the chamber and cause a reduction in quiescent ion current which triggers a false alarm. An attempt to correct this problem by the use of small or well-baffled air inlets effectively limits access to the ionization chamber of airborne combustion products, thereby reducing the sensitivity of the detector.

Attempts have also been made to produce an ionization-type smoke detector which is relatively insensitive to airflow velocity through the ionization chamber without unduly sacrificing sensitivity to airborne combustion products. One such attempt is disclosed in U.S. Pat. No. 4,185,196 in which the ionization source is designed so as to produce in the chamber a unipolar region containing charged particles of the same polarity. Furthermore, in that patent the electric field has high and low intensity regions arranged so that the airflow will carry ions from the low-intensity region to the high-intensity region so as to replace ions which are carried out of the chamber by air currents.

While this approach has been effective in reducing the adverse effects of air currents on the ionization chamber, it does so at the expense of a relatively closed chamber which has air inlet apertures at only one end thereof and, consequently, does not provide an efficient airflow path through the ionization chamber. As a result, the device of the '196 patent suffers from impaired sensitivity to combustion products, particularly the products of smoldering-type combustion.

SUMMARY OF THE INVENTION

It is a general object of the present invention to provide an improved ionization chamber for a smoke detector which avoids the disadvantages of prior art ionization chambers while affording additional structural and operating advantages.

An important object of this invention is the provision of an ionization chamber which is relatively insensitive to airflow velocity, while maintaining a high sensitivity to airborne combustion products.

It is another object of this invention to provide an ionization chamber of the type set forth, which effectively reduces airflow velocity within the chamber without adversely affecting the access of airborne combustion products to the chamber.

Another object of this invention is the provision of an ionization chamber of the type set forth which affects a high electric field at the outer boundary thereof without impeding the flow of neutral particles thereinto.

Still another object of this invention is the provision of an ionization chamber of the type set forth, which reduces the number of ions carried from the chamber by air currents therethrough.

Another object of this invention is the provision of an ionization chamber of the type set forth which is of simple and economical construction.

These and other objects of the invention are attained by providing in a smoke detector ionization chamber having first and second electrodes adapted to be connected to a source of electric power, access means for enabling airflow into and out of the chamber and means for causing ionization within the chamber, the improvement comprising: control means disposed within the chamber and cooperating with the electrodes for establishing in the chamber an electric field having a relatively higher intensity adjacent to the access means and a relatively lower intensity at locations spaced from the access means.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages, of the invention.

DESCRIPTION OF THE PREFERRED EMBODIMENT

Figure 1:
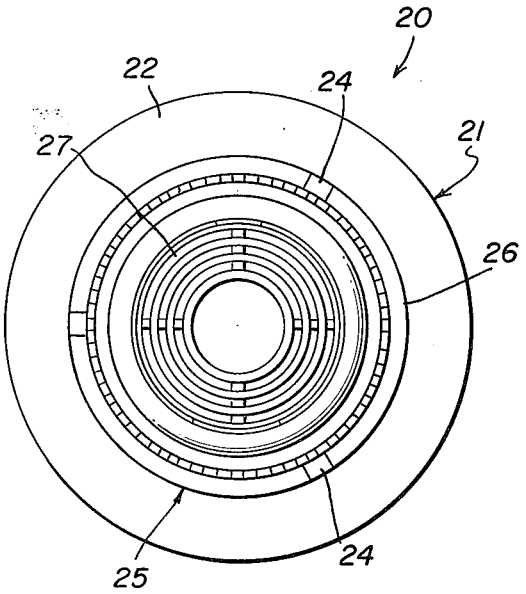
FIG. 1 is a plan view of a smoke detector in which the ionization chamber of the present invention is used.
Figure 2:
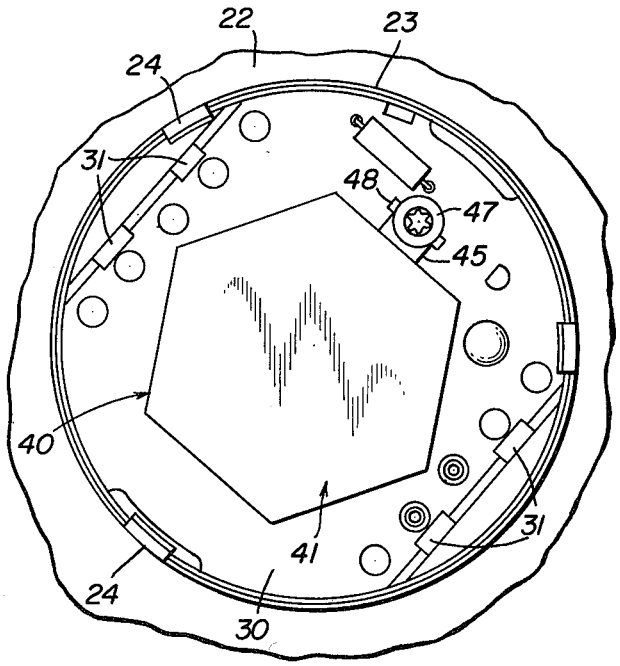
FIG. 2 is an enlarged fragmentary plan view of the smoke detector of FIG. 1 with the cover removed to show the ionization chamber.
Figure 3:
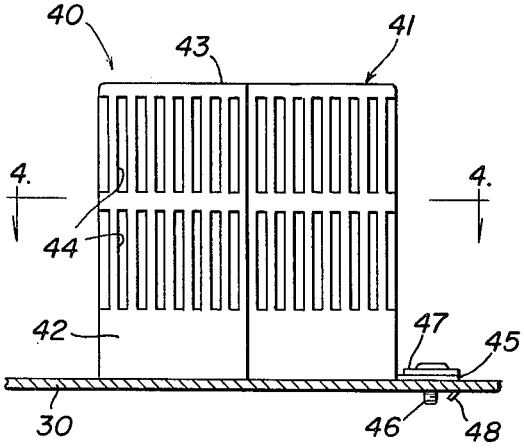
FIG. 3 is a side elevational view of the ionization chamber of FIG. 2.
Figure 6:
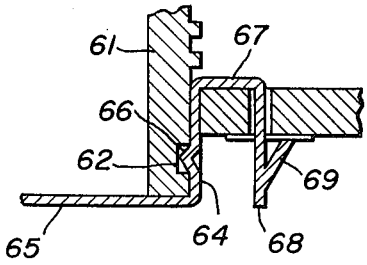
FIG. 6 is a further enlarged fragmentary view in vertical section of the means for mounting the inner electrode of the ionization chamber on the associated circuit board.

Referring to FIGS. 1 and 2 of the drawings, there is illustrated a combustion products detector, generally designated by the numeral 20, which includes a housing 21 having a circular base 22 provided with a peripheral upstanding flange 23 having attachment means 24 at spaced-apart points therealong. The housing 21 also includes a cover 25 which is generally cup-shaped and is provided with a peripheral flange 26 adapted to fit over the base flange 23 and provided with attachment portions for cooperation with the attachment means 24 on the base 22.

The cover 25 includes an end wall portion perforated with circular slots or grooves to form a grille 27 for permitting ambient air and combustion products to enter the housing 21. Preferably, the housing 21 is formed of plastic, and the attachment means therefor are adapted so that the cover 25 may be press or snap-fitted together with the base 22 for ease of assembly, yet providing a means whereby the cover is not easily removable. Suitable mounting means (not shown) are provided for mounting the combustion products detector 20 on a support surface such as a ceiling, wall or the like.

Mounted within the housing 21 on the base 22 is a printed circuit board 30 which may be formed of plastic or other suitable electrically insulating material, and is held in place by a plurality of hold-down fingers 31 which are preferably integral with the base 22. Mounted on the circuit board 30 are all of the electronic components of the combustion products detector 20, most of which form no part of the present invention and are, therefore, not shown in the drawings.

Referring now also to FIGS. 3 through 7 of the drawings, there is mounted on the printed circuit board 30 an ionization assembly, generally designated by the numeral 40 which includes a metal, generally cup-shaped housing 41 which is preferably of one-piece construction. The housing 41 includes a generally cylindrical side wall 42 hexagonal in transverse cross section and closed at one end thereof by a hexagonal end wall 43, the side wall 42 being provided with a multiplicity of equidistantly spaced-apart elongated access slots 44 therein, arranged in two vertically spaced-apart circumferential groups. Integral with the side wall 42 and extending laterally outwardly therefrom is an attachment finger 45 adapted to be secured to the printed circuit board 30 by a suitable fastener 46 such as a threaded fastener. The fastener 46 cooperates with a nut 47, secured by tabs 48 to the printed circuit board 30 and connected as by soldering to the associated circuitry.

The housing 41 cooperates with the printed circuit board 30 to define therebetween an ionization chamber, generally designated by the numeral 50 (see FIGS. 4 and 5), the housing 41 forming an outer electrode for the ionization chamber 50. The housing 41 may be two inches or less in height and about two inches in width and occupies only a small portion of the volume within the housing 21, as can best be seen in FIG. 2. It will be appreciated that the slots 44 permit ambient air and airborne combustion products to enter and leave the ionization chamber 50.

Disposed in the ionization chamber 50 is a reference assembly, generally designated by the numeral 60 (see FIG. 5), which includes a cylindrical insulator 61 disposed in a complementary circular opening in the circuit board 30 and provided with a plurality of circumferential grooves 62 in the outer surface thereof. The bottom of the insulator 61 is closed by a circular bottom cover 65 which is formed of metal and is provided at the outer edge thereof with an integral upstanding cylindrical flange 64 which is disposed in surrounding relationship with the outer surface of the insulator 61 and projects upwardly a slight distance above the circuit board 30. The flange 64 is provided with a laterally inwardly extending circumferential rib 66 (see FIG. 6) which is adapted to be received in one of the grooves 62 in the insulator 61 with a snap fit to facilitate attachment of the bottom cover 65 to the insulator 61. The flange 64 is also provided at its upper edge with spaced-apart radially outwardly extending attachment legs 67 (see FIG. 6), each provided with a downwardly extending foot 68 adapted to be received in a complementary opening in the circuit board 30 and provided with a laterally outwardly projecting prong 69 at the distal end thereof adapted to engage the underside of the circuit board 30 for attachment of the radiation source assembly 60 to the circuit board 30.

The insulator 61 is also provided with a circular top cover 70 having at the periphery thereof an integral depending cylindrical side wall 71. The side wall 71 is provided with detents 72 adapted to be snap-fitted into an associated one of the grooves 62 in the insulator 61 to facilitate attachment thereto. The side wall 71 may also be provided at the lower edge thereof with a laterally outwardly extending connecting tab 73 (see FIG. 4) to facilitate electrical connection of the top cover 70 to associated circuitry. Integral with the side wall 71 and projecting upwardly therefrom are spaced-apart attachment fingers 74. The top cover 70 forms an inner electrode for the ionization assembly 40 and cooperates with the insulator 61 and the bottom cover 65 to define a reference chamber 75.

Figure 7:
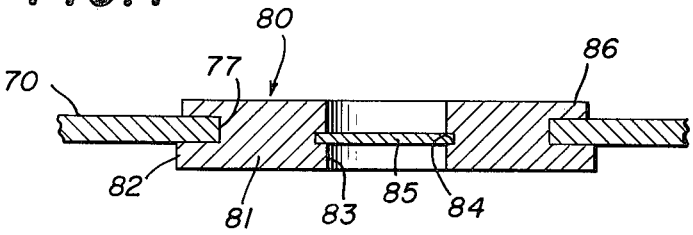
FIG. 7 is a further enlarged fragmentary view in vertical section of a portion of the inner electrode of the ionization chamber illustrated in FIG. 5, and showing the mounting of the ionization source thereon.

The top cover 70 is provided with a circular aperture 77 centrally thereof for receiving therein an associated source holder, generally designated by the numeral 80 (see FIG. 7). The source holder 80 includes a cylindrical carrier body 81 which is snugly received in the aperture 77 and is provided at the lower end thereof with a radially outwardly extending peripheral flange 82 which engages the inner surface of the top cover 70. The carrier body 81 has a circular hole 83 extending centrally therethrough, an annular shoulder or shelf 84 being formed approximately midway between the upper and lower ends of the hole 83 for supporting thereon a circular body 85 of radioactive material, typically an alpha particle emitter of a type well known in the art.

In assembly, the carrier body 81 is inserted upwardly through the aperture 77 in the top cover 70 until the peripheral flange 82 engages the underside of the top cover 70. The upper end of the carrier body 81 is then deformed by a suitable die to form an upper annular flange 86 which overlaps the upper surface of the top cover 70 firmly to attach the source holder 80 thereto.

The reference assembly 60 is disposed eccentrically with respect to the ionization chamber 50 in the preferred embodiment, to facilitate the mounting of electrical components within the ionization chamber 50. But it will be understood that the reference assembly 60 could be arranged coaxially with the ionization chamber 50.

Figure 4:
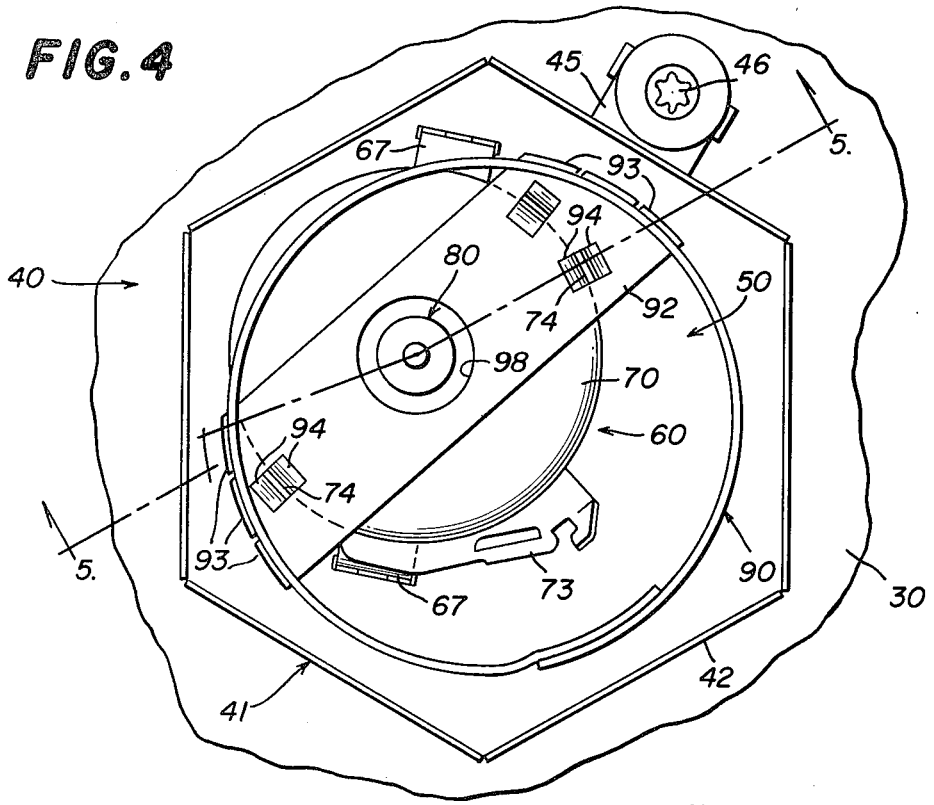
FIG. 4 is an enlarged view in horizontal section taken along the line 4—4 in FIG. 3 and illustrating the internal construction of the ionization chamber.
Figure 5:
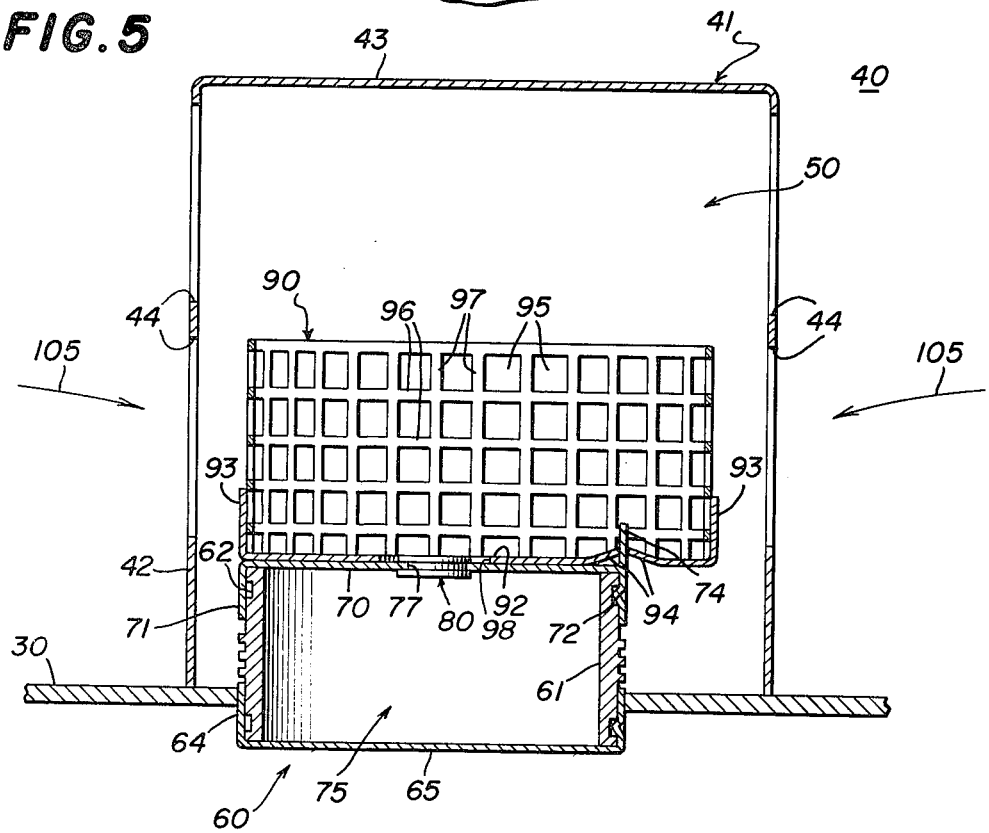
FIG. 5 is a view in vertical section taken along the line 5—5 in FIG. 4.

Referring now in particular to FIGS. 4 and 5 of the drawings, the ionization assembly 40 also includes a cylindrical control screen 90 which is formed of a wire mesh or the like and is arranged with the ends thereof overlapping and secured together. The control screen 90 is provided with an elongated flat, generally rectangular mounting strap 92, which extends across the bottom of the control screen 90 generally along a chord thereof, the mounting strap 92 being provided at each end thereof with a plurality of upstanding attachment fingers 93 which are fixedly secured to the outer surface of the control screen 90. The mounting strap 92 has punched therefrom adjacent to the opposite ends thereof pairs of mounting tabs 94.

In use, the mounting strap 92 overlies the top cover 70 of the reference assembly 60 and extends generally diametrically thereacross, with the attachment fingers 74 being respectively received between corresponding pairs of the mounting tabs 94 to be resiliently gripped thereby for attachment of the control screen 90 to the reference assembly 60. The control screen 90 includes a plurality of horizontal ribs 96 and vertical ribs 97 which intersect to define therebetween rectangular holes or openings 95. Screens with different shaped holes could be used. The mounting strap 92 is provided with a circular aperture 98 therethrough adapted to be disposed in registry with the source holder 80 to permit radiation to pass through the mounting strap 92 into the ionization chamber 50. The control screen 90 is preferably arranged coaxially with the ionization chamber 50 which means that, in the preferred embodiment, it will be eccentric with respect to the reference assembly 60.

The control screen 90 and mounting strap 92 are formed of metal and are electrically connected to the top cover 70 of the reference assembly 60. The control screen 90 preferably has a diameter substantially greater than the diameter of the top cover 70 and is adapted to just fit within the ionization chamber 50 without contacting the housing 41. More specifically, the control screen 90 is preferably spaced about two millimeters from the housing 41 at its closest approach thereto. As can be seen in FIG. 5, the height of the control screen 90 is such that when mounted in place, it extends about half way to the top of the ionization chamber 50 and is disposed immediately opposite the lower row of slots 44 in the housing 41.

Figure 9:
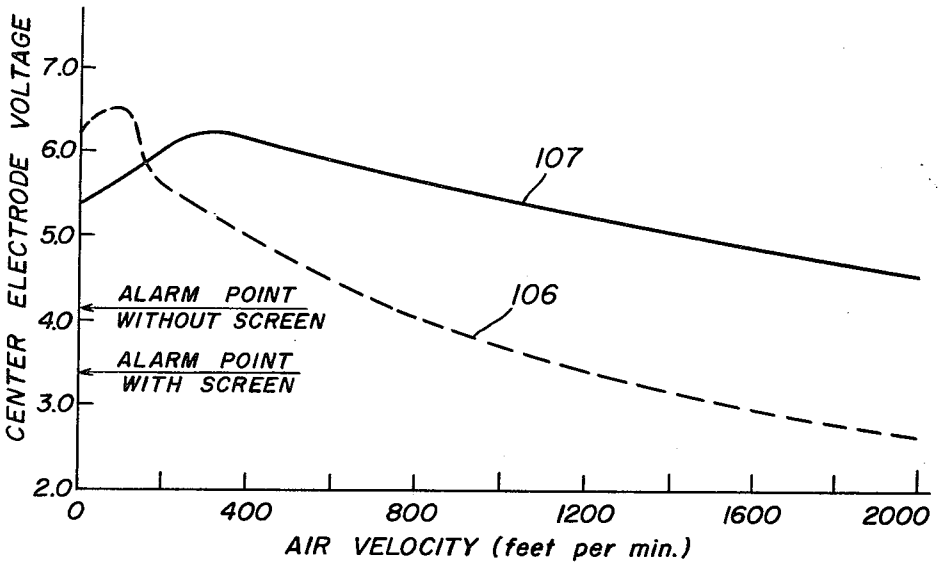
FIG. 9 is a graph of center electrode voltage versus clear air velocity in the ionization chamber of FIGS. 4 and 5.
Figure 8:
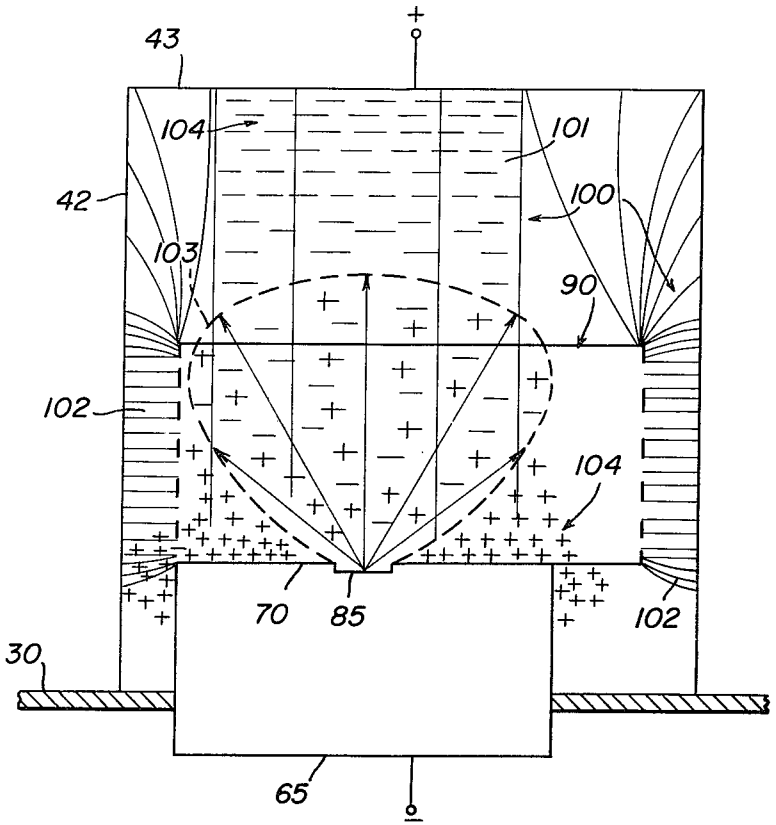
FIG. 8 is a diagrammatic representation of the ionization chamber of the present invention, illustrating the electric field pattern and ion distribution in the chamber.

Referring now also to FIGS. 8 and 9 of the drawings, the operation of the ionization assembly 40 will now be explained. It will be understood that the associated source of electric power is connected in the circuit across the electrodes formed by the housing 41 and the bottom cover 65, these electrodes being at opposite polarities as indicated and the potential therebetween establishing an electric field 100 in the ionization chamber 50. The field 100 is best illustrated by the field lines in FIG. 8, the closeness of the field lines being proportional to the intensity of the electric field. It can be seen that the electric field 100 includes a relatively low-intensity region 101 centrally of the ionization chamber 50 between the end wall 43 of the housing 41 and the top cover 70, and a relatively high-intensity region 102 between the control screen 90 and the side wall 42 of the housing 41.

The body 85 of the radioactive material emits a cloud 103 of alpha particles, the general shape of which cloud is illustrated in FIG. 8 and is determined by the recessing of the body 85 of radioactive material within the carrier body 81 of the source holder 80. It will be noted that the cloud 103 of radioactive particles extends only a slight distance above the top of the control screen 90. Within this cloud 103 the radioactive particles contact air molecules and form electrically-charged carriers in the form of positive and negative ions, represented by the plus and minus signs in FIG. 8. Because both positive and negative ions exist within the cloud 103, this area forms a bipolar region of the ionization chamber 50. However, because of the electric field 100 within the ionization chamber 50, the positive ions are attracted to the negative electrode formed by the top cover 70 and the negative ions are attracted to the positive electrode formed by the housing 41, thus resulting in a unipolar region 104 outside the range of the radioactive particles in which ions of substantially only one polarity are present. It is this movement of ions to the electrodes which creates the ion current within the ionization chamber 50.

In normal operation, when combustion products enter the ionization chamber 50, ions become attached to the smoke particles, thereby reducing the ion current and when this current has dropped to a predetermined level, an alarm will be sounded. This ion current can also be reduced by recombination of positive and negative ions in the bipolar region of the cloud 103. It is known that provision of a unipolar region 104 within the ionization chamber 50 improves the sensitivity of the device to combustion products. Thus, it would be desirable to enhance the unipolar effects.

It has been a problem in prior ionization-type smoke detectors that the airflow through the ionization chamber, indicated by the arrows 105 in FIG. 5, tends to blow ions from the ionization chamber so that they are no longer available for contribution to the ion current. In general, the higher the velocity of the airstream passing through ionization chamber, the greater the number of ions which are blown therefrom. In prior smoke detectors with bipolar ionization chambers, false alarming has occurred at air velocities in the range of about 400 feet per minute. It is an object of the present invention to significantly reduce the number of ions blown out of the ionization chamber 50, and thereby reduce the sensitivity of the combustion products detector 20 to air velocity, without impairing its sensitivity to smoke.

In this regard, it has been found that the use of the control screen 90 in the ionization chamber 50, particularly where the ionization chamber 50 has a significant unipolar region, has markedly improved the performance of the combustion products detector 20. Referring to FIG. 9 of the drawings, curve 106 is a plot of the voltage of the center electrode (top plate 70) against the velocity of clear air flowing through the ionization chamber 50 when the control screen 90 of the present invention is not used. Initially, there is a slight increase in the voltage, with a corresponding increase in chamber current, as the air velocity increases to about 100 feet per minute. As the air velocity increases beyond about 100 feet per minute, the center electrode voltage drops off, and the current of the ionization chamber 50 drops toward the alarm level, reaching that level at an air velocity of approximately 700 feet per minute.

Curve 107 is a plot of the voltage of the center electrode (top plate 70 and control screen 90) against clear air velocity when the control screen 90 of the present invention is used. It will be noted that the presence of the control screen 90 changes the configuration and impedance of the ionization chamber 50, resulting in a lowering of the initial operating voltage of the ionization chamber 50 in still air and a corresponding lowering of the alarm level of the ionization chamber 50. Again, as air velocity increases the voltage of the center electrode initially moves away from the alarm level up to an air velocity of about 400 feet per minute. As the air velocity increases beyond that point, the center electrode voltage drops off, with a corresponding drop off in the current of the ionization chamber 50, toward the alarm level. However, in this case it can be seen that the alarm level has not been reached even at an air velocity of 2,000 feet per minute. Thus, the conrol screen 90 renders the ionization chamber 50 virtually insensitive to air velocity for all practical purposes.

It is an important feature of the present invention that it achieves this significant improvement in immunity to air velocity effects while maintaining the sensitivity of the device to airborne combustion products. Thus, the ionization assembly 40 has a sensitivity of 1.1% obscuration per foot when exposed to the products of burning-type combustion, and a sensitivity of 4.5% obscuration per foot when exposed to the products of smoldering-type combustion.

As presently understood, the mechanism by which the control screen 90 achieves these results involves the operation of two phenomena. It is believed that the control screen 90, which is disposed in the path of the airflow through the ionization chamber 50, serves to decrease the velocity of the air within the ionization chamber 50. Furthermore, it is believed that the high-intensity region 102 of the electric field 100 formed between the control screen 90 and the side wall 42 of the housing 41 serves as an electrostatic barrier to the escape of ions from the ionization chamber 50 in the airstream. Effectively, the control screen 90 removes the high-intensity region 102 of the electric field 100 to a narrow band close to the housing side wall 42 which is largely beyond the region where ions are generated by alpha particles from the body 85 of radioactive material. Thus, the current flowing to the housing side wall 42 is decreased, and more negative ions flow to the housing top wall 43. This flow increases the ion density in the low field region 101 of the ionization chamber 50, and thereby increases the magnitude of the unipolar effects due to this ion density. It is a significant aspect of the present invention that the use of the control screen 90 effects a high field at the outer boundary of the ionization chamber 50 without sacrificing entry of combustion products or neutral particles.

While, in the preferred embodiment, the control screen 90 is spaced from the housing side wall 42 by about two millimeters, it will be appreciated that in general, it is desired that this spacing be as small as is permissible by the construction tolerances of the materials involved without risking contact between the control screen 90 and the housing 41. A voltage of approximately 12 volts is applied across the electrodes formed by the housing 41 and the bottom cover 65, resulting in an electric field strength of approximately 30 volts per centimeter in the high-intensity region 102 of the electric field 100, whereas the strength of the field in the low-intensity region 101 is approximately 1.5 volts per centimeter. This results in an ion velocity imparted by the electric field 100 of approximately 3 feet per minute in the low-intensity region 101 and approximately 60 feet per minute in the high-intensity region 102. Thus, this velocity caused by the electric field in the high-intensity region 102 effectively prevents ions from being blown out of that region except at very high air velocities.

It will be appreciated that the present invention achieves insensitivity to air velocity while maintaining a substantially open ionization chamber 50, i.e., without impairing the access of ambient air to the ionization chamber 50. As a result of this relatively open construction, the present invention is able to maintain a high sensitivity to airborne combustion products.

In general, it may be expected that the higher the screen, the greater the reduction it would achieve in air velocity within the ionization chamber 50. However, it will also tend to provide a greater restriction on entry of combustion products into the ionization chamber 50. Accordingly, the preferred embodiment has a control screen height which is selected as a compromise to achieve adequate insensitivity to velocity without adversely affecting the sensitivity to combustion products. Specifically, the height of the control screen 90 is preferably in the range of from about 0.6 inch to about 1 inch.

From the foregoing, it can be seen that there has been provided an improved ionization chamber for a combustion products detector which achieves virtual insensitivity to airflow velocity through the ionization chamber without significantly impairing the sensitivity of the ionization chamber to airborne products of either burning or smoldering-type combustion.

We claim:

1. In a smoke detector ionization chamber having first and second electrodes connectable to a source of electric power, means defining access openings for enabling airflow into and out of the chamber and means for causing ionization within the chamber, the improvement comprising: control structure means disposed within the chamber in the path of the airflow, said control structure means cooperating with the electrodes and the associated source of electric power for establishing in the chamber an electric field having a relatively higher intensity closely adjacent to the access openings and a relatively lower intensity in the remainder of the chamber without significantly impairing the flow of neutral particles into the chamber.

2. The ionization chamber of claim 1, wherein said control structure means is electrically conductive.

3. The ionization chamber of claim 2, wherein said control structure means is electrically connected to one of the electrodes.

4. The ionization chamber of claim 1, wherein the higher intensity region of said electric field is disposed between said control structure and one of the electrodes.

5. The ionization chamber of claim 1, wherein the higher intensity region of said electric field is disposed so as to inhibit the escape of charged carriers from the chamber in the airflow.

6. The ionization chamber of claim 1, wherein said control structure means comprises a screen.

7. In a smoke detector ionization chamber having inner and outer electrodes connectable to a source of electric power, access means for enabling airflow into and out of the chamber and means for causing ionization within the chamber, the improvement comprising: an electrically conductive control structure means disposed within the chamber in the path of the airflow for reducing the airflow velocity within the chamber, said control structure means being electrically connected to the inner electrode and spaced from the outer electrode, said control structure means cooperating with the electrodes and with the associated source of electric power for establishing in the chamber an electric field having a region of high-intensity relative to the remainder of the field, said region being disposed for inhibiting movement of ions from the chamber in the airflow without significantly impairing the flow of neutral particles into the chamber.

8. The ionization chamber of claim 7, wherein said control structure means is supported by the inner electrode.

9. The ionization chamber of claim 7, wherein said relatively high-intensity region of said electric field is disposed between said control structure means and the outer electrode.

10. The ionization chamber of claim 9, wherein the current in said control structure means is an inverse function of the airflow velocity in the chamber.

11. The ionization chamber of claim 7, wherein said control structure means is spaced from the outer electrode a distance of approximately 2 millimeters.

12. The ionization chamber of claim 7, wherein said high-intensity region of said electric field has a field strength of approximately 30 volts per centimeter.

13. The ionization chamber of claim 7, wherein said control structure means is substantially coaxial with said outer electrode.

14. The ionization chamber of claim 7, wherein the maximum velocity resulting from said electric field is approximately 60 feet per minute.

15. The ionization chamber of claim 7, wherein said control structure means comprises a screen having rectangular openings.

16. In a smoke detector ionization chamber having a circular inner electrode and an outer electrode both connectable to a source of electric power, access means for enabling airflow into and out of the chamber and means for causing ionization within the chamber such that the chamber has a unipolar region in which substantially only one polarity of charged carriers exist and a bipolar region in which charged carriers of opposite polarity exist, the improvement comprising: a substantially cylindrical electrically conductive control means having a diameter greater than that of the inner electrode disposed in the path of the airflow for reducing the airflow velocity within the chamber, said control means being electrically connected to the inner electrode and being spaced from the outer electrode, said control means cooperating with the electrodes and with the associated source of electric power for establishing in the chamber an electric field having a region of high-intensity relative to the remainder of the field, said region being disposed for inhibiting movement of ions from the chamber in the airflow.

17. The ionization chamber of claim 16, wherein the axial height of said control means is slightly less than the height of the bipolar region in the same direction.

18. The ionization chamber of claim 16, wherein said control means substantially encircles the bipolar region.

19. The ionization chamber of claim 16, wherein the axis of said control means is substantially parallel to the axis of the inner electrode and spaced a predetermined distance therefrom.

20. The ionization chamber of claim 16, wherein said high-intensity region of said electric field is disposed between said control means and said outer electrode.

21. The ionization chamber of claim 16, wherein the outer electrode is cylindrical and said control means is substantially coaxial therewith.

22. The ionization chamber of claim 16, wherein said control means comprises a screen.

23. A smoke detector ionization chamber comprising an outer electrode defining the chamber, an inner electrode disposed within the chamber, said inner and outer electrodes being connectable to an associated source of electric power, said outer electrode having a generally cylindrical side wall with apertures therein for enabling airflow into and out of the chamber, ionization means for radiating alpha particles into a bipolar region of the chamber in which charged carriers of opposite polarity exist, and a generally cylindrical electrically conductive control means disposed in the chamber substantially coaxially with said outer electrode and in the path of the airflow for reducing the airflow velocity within the chamber, said control means being electrically connected to said inner electrode and spaced from said outer electrode, said control means cooperating with said electrodes and with the associated source of electric power for establishing in the chamber an electric field having a region of high-intensity relative to the remainder of said field, said region being disposed between said control means and said outer electrode for inhibiting movement of ions from the chamber in the airflow.

24. The ionization chamber of claim 23, wherein said ionization means is supported by said inner electrode.

25. The ionization chamber of claim 23, wherein said control means is supported by said inner electrode.

26. The ionization chamber of claim 23, wherein said side wall of said outer electrode is hexagonal in transverse cross section.

27. The ionization chamber of claim 23, wherein said inner electrode is circular in shape.

28. The ionization chamber of claim 27, wherein the axis of said outer electrode is substantially parallel to the axis of said inner electrode and spaced a predetermined distance therefrom.

29. The ionization chamber of claim 23, wherein said control means comprises a screen.

* * * * *